United States Patent [19]

Otani et al.

[11] 4,450,684

[45] May 29, 1984

[54] EXHAUST GAS CLEANING SYSTEM FOR INTERNAL COMBUSTION ENGINE

[75] Inventors: Junji Otani, Oomiya; Yasuo Ikenoya, Kawagoe; Hiroshi Kato, Urawa, all of Japan

[73] Assignee: Honda Giken Kogyo Kabushiki Kaisha, Tokyo, Japan

[21] Appl. No.: 411,024

[22] Filed: Aug. 24, 1982

[30] Foreign Application Priority Data

Aug. 24, 1981 [JP] Japan ..... 56-132413

[51] Int. Cl.[3] ..... F02B 75/15; F01N 3/22

[52] U.S. Cl. ..... 60/290; 60/293

[58] Field of Search ..... 60/293, 290, 304, 305

[56] References Cited

U.S. PATENT DOCUMENTS

| | | | |
|---|---|---|---|
| 3,751,915 | 8/1973 | Ranft | 60/293 |
| 3,974,651 | 8/1976 | Nakajima | 60/290 |
| 4,014,169 | 3/1977 | Umino | 60/290 |
| 4,075,834 | 2/1978 | Saito | 60/293 |
| 4,148,189 | 4/1979 | Siki | 60/290 |
| 4,215,542 | 8/1980 | Kobayashi | 60/293 |

*Primary Examiner*—Douglas Hart

*Attorney, Agent, or Firm*—Armstrong, Nikaido, Marmelstein & Kubovcik

[57] ABSTRACT

An exhaust gas cleaning system for an internal combustion engine having an exhaust system leading to an exhaust port of an engine body. The exhaust gas cleaning system comprises a TWC catalyst disposed in the exhaust system for simultaneously cleaning HC, CO and $NO_X$ in exhaust gas flowing through the exhaust system. A secondary-air supply passage is connected to the exhaust system on the upstream side of the TWC catalyst and coupled to the atmosphere. A check valve is disposed in the secondary-air supply passage, wherein the check valve is opened by the exhaust gas pulsation generated in the exhaust system and a secondary air control valve is positioned in the secondary-air supply passage on the upstream side of the check valve, wherein the secondary-air control valve increases the flow rate of the secondary air supplied to the exhaust system in the low-speed revolution range of the engine and decreases the flow rate of the secondary air supplied to the exhaust system in the accelerating and high-speed revolution ranges of the engine such that the atmosphere of the TWC catalyst becomes oxidative in the low-speed revolution range of the engine while the catalyst atmosphere becomes close to that of a stoichiometric ratio in the accelerating and high-speed revolution ranges.

3 Claims, 3 Drawing Figures

EXHAUST GAS CLEANING SYSTEM FOR INTERNAL COMBUSTION ENGINE

BACKGROUND OF THE INVENTION

1. Field of the Invention

The present invention relates to an exhaust gas cleaning system for an internal combustion engine to effectively remove HC, CO and $NO_X$ in exhaust gas by disposing a three-way conversion (TWC) catalyst in the exhaust system in the internal combustion engine and enlarging the cleaning range of the catalyst.

2. Description of the Prior Art

A cleaning system for cleaning the exhaust gas of an internal combustion engine has been known to include a TWC catalyst disposed in the intermediate part of the exhaust system to oxidize or reduce HC, CO and $NO_X$ thereby to clean the exhaust gas.

SUMMARY OF THE INVENTION

A primary object of the present invention is to provide a simply constructed exhaust gas cleaning system for an internal combustion engine to remove HC and CO generated mostly in the low-speed operation range of the engine by means of oxidation through making the catalyst atmosphere oxidative in the operation range.

It is another primary object of the present invention to remove $NO_X$ generated mostly in the accelerating and high-speed operation ranges of the engine by means of reduction through making the catalyst atmosphere close to that of a stoichiometric ratio as well as to remove HC and CO generated also in these operation ranges by means of oxidation so that the range of use of the TWC catalyst is enlarged overall, thereby to effect an efficient exhaust gas cleaning.

BRIEF DESCRIPTION OF THE DRAWINGS

The following drawings illustrate a preferred embodiment of the present invention, in which.

DESCRIPTION OF THE PREFERRED EMBODIMENT

A preferred embodiment of the present invention, particularly when applied to an internal combustion engine for a motorcycle, will be described hereinunder with reference to the accompanying drawings.

Figure 1:
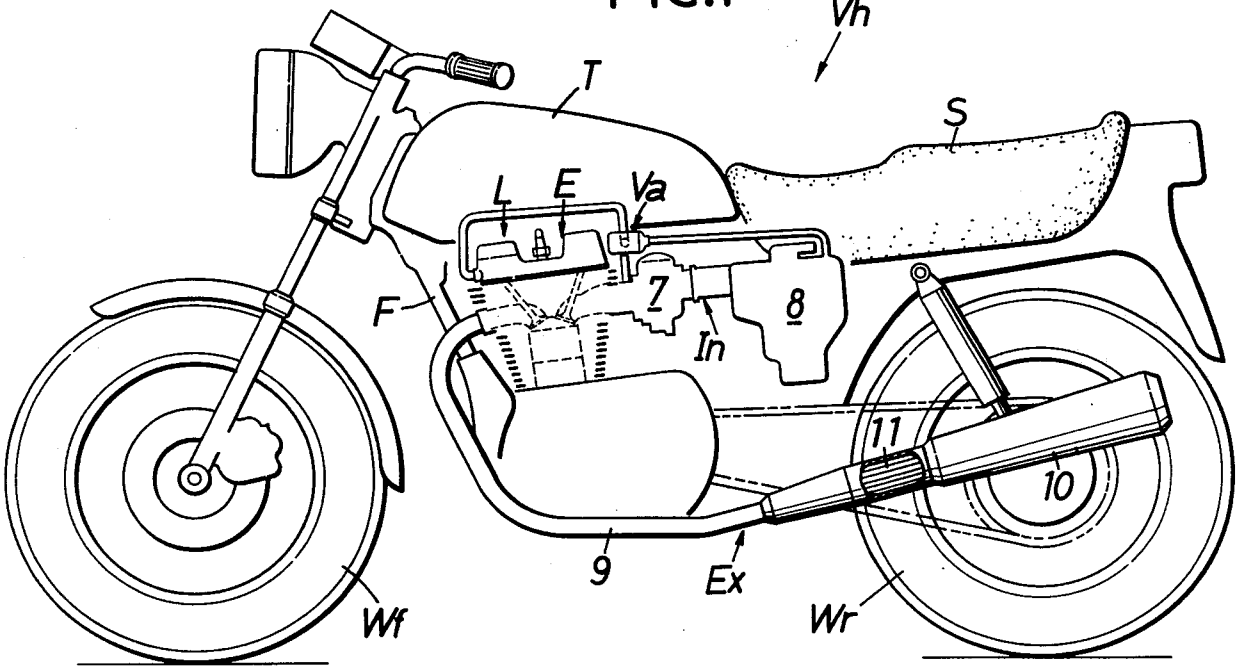
FIG. 1 is a perspective view of an internal combustion engine equipped with an exhaust gas cleaning system according to the present invention.

In FIG. 1, a fuel tank T and a seat S are supported on the upper part of a frame F of a motorcycle Vh, while a front wheel Wf and a rear wheel Wr are suspended in the front and rear of the frame F respectively. Within the space surrounded therewith, an internal combustion engine E for driving the rear wheel Wr is laterally mounted on the frame F.

Figure 2:
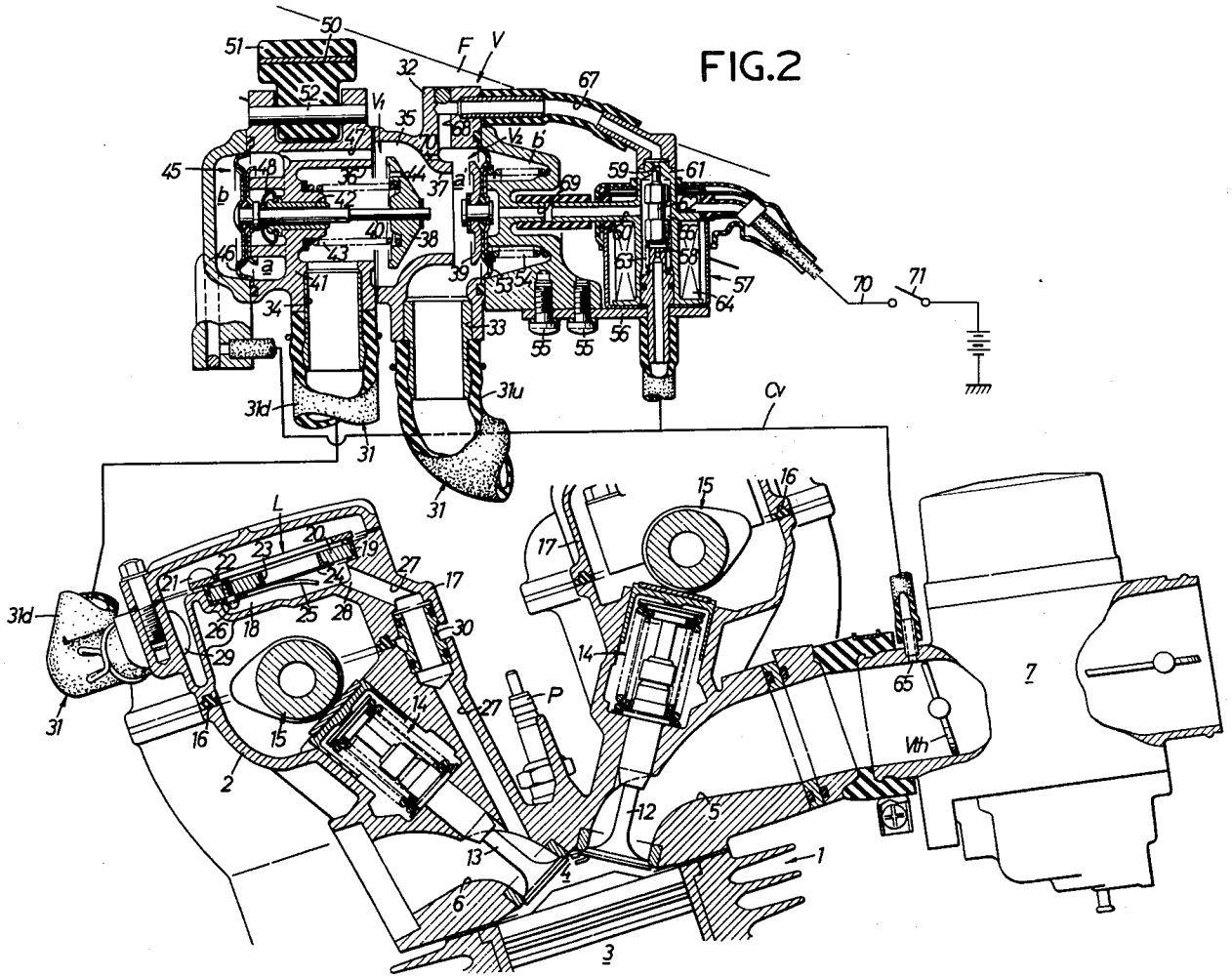
FIG. 2 is a sectional side elevational view of the exhaust gas cleaning system according to the present invention.

In FIG. 2, a cylinder head 2 of an engine main body 1 has an intake port 5, formed in its rear half part, coupled to a combustion chamber 4 above a piston 3. An exhaust port 6 is formed in the front half part of the cylinder head 2 and is coupled to the combustion chamber 4. The intake port 5 opens to the rear face of the engine main body 1 while the exhaust port 6 opens to the front face thereof. As shown in FIG. 1, the intake port 5 is connected with an intake system, consisting of a carburetor 7 and an air cleaner 8, disposed to the rear of the engine main body 1, while the exhaust port 6 is connected with an exhaust system Ex consisting of an exhaust pipe 9 and an exhaust muffler 10. A TWC catalyst 11 for cleaning exhaust gas is positioned in an intermediate part of the exhaust muffler 10. Moreover, the cylinder head 2 is provided with an intake valve 12 and an exhaust valve 13, as usual, to open and close the intake and exhaust ports 5 and 6 to the combustion chamber 4 respectively. Each of the valves 12 and 13 are opened and closed through cooperation between a valve spring 14 and a valve-actuating mechanism 15. The cylinder head 2 is provided with an ignition plug P between the intake and exhaust valves 12 and 13.

A head cover 17 covering the exhaust valve 13 of the cylinder head 2 through a packing material 16 is provided with a check valve or a reed valve L adapted to operate in response to the pulsation pressure of exhaust gas.

A valve chamber 18 is formed in the head cover 17 and a reed valve 20 is housed in the valve chamber 18 through a heat-resistant packing 19, the reed valve 20 being secured to the head cover 17 through a mounting plate 22 by means of a mounting screw 21. A valve bore 23 is formed in the reed valve 20, while a reed 24 opens and closes the valve bore 23 and a reed stopper 25 limits the opening of the reed 24 which is secured to the lower surface of the reed valve 20 by means of a setscrew 26.

In the cylinder head 2 of the engine main body 1 and the head cover 17, a secondary-air passage 27 is formed therebetween. The upper end of the passage 27 is coupled to an outlet 28 of the valve chamber 18 of the reed valve L while the lower end of the passage 27 is coupled to a portion of the exhaust port 6 near the exhaust valve 13.

In addition, the portions of the secondary-air passage 27 on the side of the cylinder head 2 and on the side of the head cover 17 respectively, are hermetically connected with a connection pipe 30 when the cylinder head 2 and the head cover 17 are assembled together. The connection pipe 30 is also used as a guide member in assembling the cylinder head 2 and the head cover 17 together.

An inlet 29 opening into the valve chamber 18 of reed valve L is coupled to a secondary-air supply passage 31 coupled to the cleaning chamber of the air cleaner 8. The vacuum produced by the pulsation pressure of exhaust gas in the exhaust port 6 through the operation of the engine E causes the reed 24 to intermittently open, so that secondary air from the air cleaner 8 can be introduced into the exhaust port 6 through the secondary-air supply passage 31, the reed valve L and the secondary-air passage 27.

A secondary-air control valve mechanism V, which controls the flow rate of the secondary air supplied to the exhaust port 6, is positioned in an intermediate portion of the secondary-air supply passage 31. The control valve mechanism V comprises a first control valve $V_1$ adapted to cut off the secondary-air supply passage 31 in the decelerating or snap operation of the engine E in order to stop the supply of the secondary air to the exhaust system Ex and a second control valve $V_2$ adapted to similarly cut off the secondary-air supply passage 31 in the high-speed or accelerating operation of the engine E so as to stop the supply of the secondary air to the exhaust system Ex. The control valve mechanism V is adapted to be able to enlarge the range of use of the TWC catalyst 11 by using it as both a TWC catalyst and an oxidizing catalyst through the cooperation between these first and second control valves $V_1$ and $V_2$. The construction of the control valve mechanism V will be described hereinunder in detail.

A valve casing 32 in which the first and second control valves $V_1$ and $V_2$ are housed is supported by a bracket 50 secured to the frame F, through a rubber mount 51 and a mounting pin 52. The valve casing 32 has an inlet port 33 and an outlet port 34 for secondary air which are opened in parallel to each other. The inlet port 33 is coupled to the upstream-side passage 31*u* of the secondary-air supply passage 31 leading to the air cleaner 8 (FIG. 1), while the outlet port 34 is coupled to the downstream-side passage 31*d* of the secondary-air supply passage 31 leading to the reed valve L. The valve casing 32 has a valve chamber 35 therein, in which a first valve port 36 and a second valve port 37 are formed, and the inlet and outlet ports 33 and 34 are coupled to each other through the valve ports 36 and 37.

The first valve port 36 is opened and closed by the first control valve $V_1$, while the second valve port 37 is opened and closed by the second control valve $V_2$.

The construction of the first control valve $V_1$ will be described hereinunder: A first valve body 38, which opens and closes the first valve port 36, is housed in the valve chamber 35, and a valve rod 40, connected to the valve body 38, is reciprocably supported through a guide sleeve 42 provided in a wall surface 41 in the valve casing 32. A valve spring 43 is biased between the wall surface 41 of the valve chamber 35 and the valve body 38, the resilient force of the valve spring 43 being directed to bias the first valve body 38 to open the first valve port 36.

Moreover, a leak bore 44 is formed in the first valve body 38 so that some secondary air is supplied to the exhaust system Ex through the leak bore 44 and the secondary-air supply passage 31 even when the first valve body 38 closes the first valve port 36. A diaphragm actuating chamber 45 is formed with the wall surface 41 between the chamber 45 and the valve chamber 35. The diaphragm actuating chamber 45 is partitioned into an atmospheric pressure chamber a and a vacuum chamber b by means of a diaphragm 46 across the chamber 45. One end of the valve rod 40 projects into the diaphragm actuating chamber 45 and is connected to the diaphragm 46. The atmospheric pressure chamber a is coupled to the upstream-side passage 31*u* through an atmospheric air passage 47 and the valve chamber 35, while the vacuum chamber b is coupled to a portion of the intake passage on the downstream-side from a throttle valve Vth of the carburetor 7 through a vacuum circuit Cv so as to be affected by the intake vacuum on the downstream-side from the throttle valve Vth.

In the atmospheric pressure chamber a, both ends of a boot 48 made of a flexible material such as rubber, synthetic resin material or the like, are hermetically connected to the ends of the wall surface 41 and the valve rod 40 respectively so that the atmospheric pressure chamber a and the valve chamber 35 are hermetically sealed from each other by the boot 48 to thereby prevent the air passing through the gap between the guide sleeve 42 and the valve rod 40 from flowing into the atmospheric pressure chamber a.

The construction of the second control valve $V_2$ will be described hereinunder: A diaphragm 53 separating an atmospheric pressure chamber a' and a vacuum chamber b' from each other is placed across one side of the valve chamber 35 communicated with the secondary-air supply passage 31. The atmospheric pressure chamber a' is constantly coupled to the upstream-side passage 31*u* as well as to the valve chamber 35 through the second valve port 37. A second valve body 39, which opens and closes the second valve port 37, is secured to one side surface of the diaphragm 53 facing the atmospheric pressure chamber a'. In the vacuum chamber b', a diaphragm spring 54 is biased to push the diaphragm 53 toward the second valve port 37. When the vacuum in the vacuum chamber b' rises, the second valve body 39, together with the diaphragm 53, separates from the second valve port 37 against the resilient force of the diaphragm spring 54, thereby opening the second valve port 37.

A stay 56 is secured to one side (the right-hand side in FIG. 2) of the valve casing 32 by means of mounting screws 55 in order to support a solenoid valve 57. The solenoid valve 57 comprises a valve chamber 66 of a valve main body 61 having a first inlet port 58 and a second inlet port 59 opened facing each other and a single outlet port 60 opened therebetween. A valve body 62 opens and closes the first and second inlet ports 58 and 59 alternately and a valve spring 63 biases the valve body 62 in a direction to close the second inlet port 59. A solenoid 64 for energizing the valve body 62 in a direction as to open the second inlet port 59 against the resilient force of the valve spring 63, is provided surrounding the valve main body 61. The first inlet port 58 is coupled to the vacuum circuit Cv coupled to a vacuum outlet port 65 opening into the intake passage on the downstream-side from the throttle valve Vth of the carburetor 7, while the second inlet port 59 is coupled to an atmospheric air passage 67, the other end of which is communicated with the atmospheric pressure chamber a' through an atmospheric air inlet port 68 bored in the wall of the valve casing 32. In addition, a leak bore 72 is formed in the wall of the valve casing 32, to couple the valve chamber 35 and the atmospheric pressure chamber a' with each other even when the second valve body 39 closes valve port 37, to leak the atmospheric air to the side of the valve chamber 35.

On the other hand, the outlet port 60 is coupled to the vacuum chamber b' of the second control valve $V_2$ through a passage 69 formed in the valve casing 32.

An on-off switch 71 of a speed sensor of the motorcycle is connected to an intermediate portion of a power circuit 70 leading to the solenoid 64, the switch 71 being adapted to be closed when the speed of the motorcycle is above a given value (for example, 70 K/H).

The operation of the preferred embodiment of the present invention will be described hereinunder.

In the decelerating operation of the engine, the throttle valve Vth of the carburetor 7 has a small opening, so that a high intake vacuum (above 450 mmHg) on the downstream side from the throttle valve Vth acts on the vacuum chamber b of the first control valve $V_1$ through the vacuum circuit Cv, causing the diaphragm 46 to move leftward in FIG. 2 by means of suction whereby the first valve body 38 closes the first valve port 36. In this case, a necessary minimum amount of the secondary air is supplied to the exhaust port 6 from the leak bore 44 in the first valve body 38 through the downstream-side passage 31*d*. The secondary air is, however, only of such an extent as to promote the combustion of the unburned component of the engine exhaust. Therefore, substantially no secondary air is supplied to the exhaust port 6, thereby preventing the occurrence of after burning. In this case, when the atmosphere of the TWC catalyst 11 becomes close to that of a stoichiometric ratio, the catalyst 11 performs both reduction and oxidation, cleaning HC, CO and $NO_X$ in the exhaust gas.

When the engine E enters into its low-speed operation range, the intake vacuum after the throttle valve Vth gradually lowers (for example, 250 mm to 100 mmHg), and the vacuum in the vacuum chamber b also lowers, so that the first valve body 38 opens valve port 36 as a result of the resilient force of the valve spring 43. In addition, because in the abovementioned operation range of the engine E, the speed of the motorcycle is low (below 70 K/H) and the switch 71 is open, the valve body 62 of the solenoid valve 57 closes the second inlet port 59, so that the intake vacuum (250 mm to 100 mmHg) on the downstream side from the throttle valve Vth acts on the inside of the vacuum chamber b' of the second control valve $V_2$ through the first inlet port 58 and the outlet port 60, causing the second valve body 39 to open the second valve port 37 (set so as to open with a vacuum above 95 mmHg) against the valve spring 54 to thereby open the second valve port 37.

Accordingly, because both the valve ports 36 and 37 of the first and second control valves $V_1$ and $V_2$ are opened in the low-speed operation range of the engine E, the secondary-air supply passage 31 is brought into a communicating state, allowing the reed valve L to communicate with the atmospheric air through the air cleaner 8 (FIG. 1).

On the other hand, the exhaust gas pulsation pressure produced through the operation of the internal combustion engine E reaches the reed valve L through the secondary-air passage 27 and opens the valve L, so that the clean air from the air cleaner 8 flows to the reed valve L through the secondary-air supply passage 31, and because the secondary-air control valve mechanism V is opened as mentioned above, it is introduced to the exhaust port 6 therefrom through the secondary-air passage 27.

The introduced secondary air in the exhaust port 6 is mixed in the exhaust gas, partially oxidizing HC and CO mixed in the exhaust gas in the exhaust port 6 and the exhaust pipe 9, and further, the exhaust gas mixed with the secondary air is supplied to the TWC catalyst 11 from the exhaust muffler 10, making the atmosphere of the catalyst 11 oxidative, thereby allowing it to function as an oxidizing catalyst to change mainly CO and HC in the exhaust gas into $CO_2$ and $H_2O$ through oxidation respectively.

Because the engine has a small amount of intake air in its low-speed operation range and consequently the air-fuel mixture is not excellently burned as compared to other operation ranges, the amount of generation of $NO_X$ is rather small but the amounts of generation of HC and CO are rather large in the operation range. However, because it is possible to make the TWC catalyst 11 function as an oxidizing catalyst by supplying it with the secondary air to make the air-fuel mixture leaner, HC and CO can be efficiently eliminated by the use of the TWC catalyst 11.

When the opening of the throttle valve Vth of the engine E increases and it enters into its accelerating operation range, there is a reduction in the intake vacuum in the intake passage on the downstream side from the throttle valve Vth, and also the vacuum acting on the vacuum chamber b' of the second control valve $V_2$ through the solenoid valve 57 becomes low (below 95 mmHg), so that the diaphragm 53 is moved leftward in FIG. 2 by means of the resilient force of the diaphragm spring 54, causing the second valve body 39 to close the second valve port 37. Consequently, the secondary-air supply passage 31 is cut off by the closing of the second control valve $V_2$, so that the supply of the secondary air to the exhaust port 6 is stopped.

Further, when the engine enters into its high-speed operation range and the speed of the motorcycle exceeds the set value (70 K/H), the on-off switch 71 of the speed sensor is closed to energize the solenoid 64 of the solenoid valve 57, so that the valve body 62 is attracted downward in FIG. 2 to close the first inlet port 58 and open the second inlet port 59 simultaneously. Consequently, the atmospheric air in the atmospheric pressure chamber a' flows into the vacuum chamber b' of the second control valve $V_2$ through the atmospheric air inlet port 68, the atmospheric air passage 67 and the solenoid valve 57, so that the diaphragm spring 54, together with the diaphragm 53, moves the second valve body 39 leftward in FIG. 2 to close the second valve port 37. Also in this case, the secondary-air supply passage 31 is cut off and maintained in the cut off state in the high-speed operation range independently of the opening of the throttle valve Vth, i.e., the magnitude of the intake vacuum, thus, no secondary air is supplied to the exhaust port 6 of the engine E.

Thus, because the second valve port 37 of the second control valve $V_2$ is closed by the second valve body 39 in both the accelerating and high-speed operation ranges of the engine, the greater part of the secondary air is not supplied to the exhaust system Ex but a necessary minimum of the secondary air is supplied to the exhaust port 6, flowing to the downstream-side passage 31*d* only from the leak bore 72 through the first valve port 36. On the other hand, in the accelerating and high-speed operation ranges, the air-fuel ratio of the air-fuel mixture formed by means of the carburetor 7 is previously set to be slightly richer than a stoichiometric ratio so that the atmosphere of the TWC catalyst 11 is close to that of a stoichiometric ratio ($A/F=14.5\pm0.1$).

Thereby, the TWC catalyst 11 has a reducing and oxidizing atmosphere in which it most easily displays its performance as a TWC catalyst, so that $NO_X$ and CO, HC can all be effectively removed. Accordingly, a high cleaning rate can be obtained.

Figure 3:
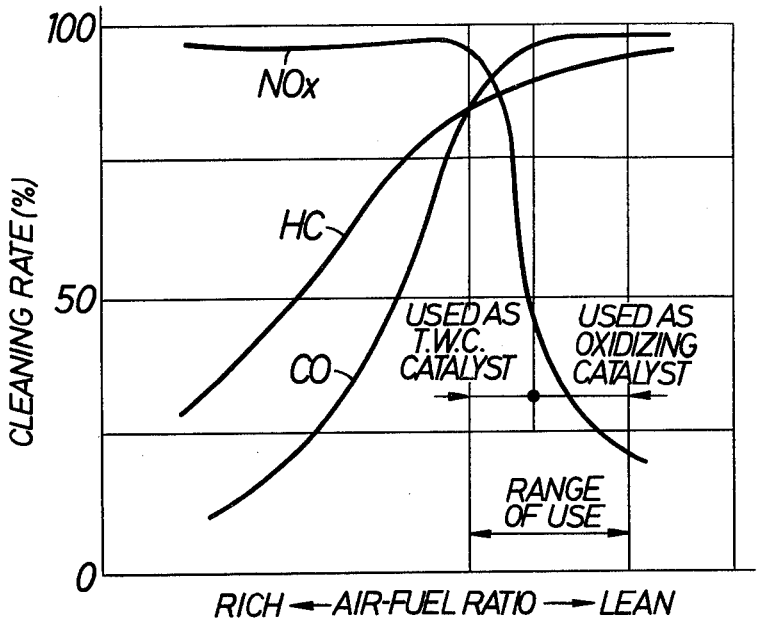
FIG. 3 is a graph showing the characteristics of a TWC catalyst used in the exhaust gas cleaning system according to the present invention.

FIG. 3 shows the characteristics of the TWC catalyst used in the preferred embodiment of the present invention by way of a graph. As is apparent from the graph, according to the present invention, the TWC catalyst 11 is made to function as an oxidizing catalyst in the low-speed operation range of the engine so that it is possible to remove HC and CO generated mostly in the operation range of the engine with a high cleaning rate, while the TWC catalyst 11 is made to function as an original TWC catalyst in the accelerating and high-speed operation ranges of the engine so that it is possible to remove $NO_X$ and HC, CO with a high cleaning rate, thereby to make it possible to enlarge the range of use of the TWC catalyst 11.

As mentioned above, according to the present invention, because the TWC catalyst is disposed in the exhaust system of the engine, and the check valve, which is opened by means of the exhaust gas pulsation produced in the exhaust system, is disposed in the exhaust system on the upstream side from the TWC catalyst, and the secondary-air control valve is disposed on the upstream side of the check valve, and because the control valve mechanism has the control valves adapted to increase the flow rate of the secondary air supplied to the exhaust system in the low-speed operation range of the engine while decreasing the flow rate of the secondary air supplied to the exhaust system in the accelerating and high-speed operation ranges of the engine, the atmosphere of the TWC catalyst 11 becomes oxidative in the low-speed operation range of the engine while the catalyst atmosphere becomes close to that of a stoichiometric ratio in the accelerating and high-speed operation ranges of the engine. Thus, it is possible to effectively oxidize and reduce HC, CO and $NO_X$ in the exhaust gas in the low-speed operation range and the accelerating and high-speed operation ranges of the engine, thereby allowing the range of use of the TWC catalyst to be greatly enlarged. Particularly, because it is possible to oxidize HC and CO in the exhaust gas on the upstream side from the TWC catalyst by the supply of the secondary air to the exhaust system, the cleaning load of the TWC catalyst can be reduced, so that its durability can be largely improved, and further the oxidizing reactions of HC and CO on the upstream side from the TWC catalyst result in a rise in temperature of the exhaust gas, causing the inlet temperature of the TWC catalyst to be raised, thereby allowing the cleaning performance of the catalyst to be further improved.

In addition, unlike conventional TWC catalysts, there is no need for an $O_2$ sensor for measuring the oxygen concentration in the exhaust gas and a controller for controlling the air-fuel ratio of the air-fuel mixture through feeding back the values obtained by the sensor. Accordingly, it is possible to obtain an exhaust gas cleaning system which is inexpensive and excellent in reliability and durability.

Moreover, when the exhaust gas cleaning system according to the present invention is applied to an internal combustion engine for a motorcycle forming the secondary-air supply passage integrally with the cylinder block, the cylinder head, the cylinder head cover or the like, it eliminates the need for piping on the outside of the engine main body, thereby to suppress the effect of external disturbance. In addition, the number of parts needed for the cleaning system can be reduced, so that it is possible to facilitate assembling, simplify the structure and further improve the maintainability.

The present invention may be embodied in other specific forms without departing from the spirit or essential characteristics therefor. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is

1. An exhaust gas cleaning system for an internal combustion engine having an exhaust system leading to an exhaust port of an engine body, said exhaust gas cleaning system comprising:

a TWC catalyst disposed in the exhaust system for simultaneously cleaning HC, CO and $NO_X$ exhaust gas flowing through the exhaust system;

a secondary-air supply passage means connected to the exhaust system on the upstream side of the TWC catalyst and coupled to the atmosphere;

a check valve means disposed in the secondary-air supply passage, wherein said check valve means is opened by the exhaust gas pulsation generated in the exhaust system; and a secondary-air control valve means positioned in the secondary-air supply passage means on the upstream side of said check valve means, wherein said secondary-air control valve means increases the flow rate of the secondary air supplied to said exhaust system in the low-speed revolution range of the engine and decreases the flow rate of the secondary air supplied to said exhaust system in the accelerating and high-speed revolution ranges of the engine such that the atmosphere of said TWC catalyst becomes oxidative in the low-speed revolution range of the engine while the catalyst atmosphere becomes close to that of a stoichiometric ratio in the accelerating and high-speed revolution ranges.

2. An exhaust gas cleaning system for an internal combustion engine as defined in claim 1, wherein said secondary-air control valve means comprises a first control valve means for cutting off said secondary-air supply passage to stop the supply of the secondary air to said exhaust system during deceleration of the engine and a second control valve means for cutting off said secondary-air supply passage to stop the supply of the secondary air to said exhaust system during acceleration and high-speed operations of the engine.

3. An exhaust gas cleaning system for an internal combustion engine as defined in claim 1 or claim 2, wherein said check valve means includes a reed valve.

* * * * *